United States Patent [19]

Palmer et al.

[11] 4,099,757

[45] Jul. 11, 1978

[54] DOOR CATCHES

[75] Inventors: John P. Palmer; Colin W.F. Clinch, both of Woodley; David N. Harley, Bournemouth, all of England

[73] Assignee: ITW Limited, Windsor, England

[21] Appl. No.: 782,254

[22] Filed: Mar. 28, 1977

[30] Foreign Application Priority Data

Mar. 30, 1976 [GB] United Kingdom ..... 12674/76

[51] Int. Cl.[2] ..... E05C 3/30

[52] U.S. Cl. ..... 292/336.3; 292/126

[58] Field of Search ..... 292/336.3, DIG. 27, 292/DIG. 65, 114, 126; 70/360

[56] References Cited

U.S. PATENT DOCUMENTS

| | | | |
|---|---|---|---|
| 1,169,659 | 1/1916 | Lowell | 292/DIG. 27 |
| 2,670,981 | 3/1954 | Wenham | 292/114 |
| 2,731,821 | 1/1956 | Lloyd | 292/199 X |
| 3,918,751 | 11/1975 | Blake | 292/126 |

FOREIGN PATENT DOCUMENTS

| | | | |
|---|---|---|---|
| 1,293,004 | 4/1962 | France | 292/126 |

*Primary Examiner*—Richard E. Moore

*Attorney, Agent, or Firm*—Jack R. Halvorsen; Robert W. Beart

[57] ABSTRACT

The invention concerns a child-proof door catch device which requires a sequence of unconnected manipulations to operate the mechanism opening a door. The mechanism includes a housing and operating and latching elements, the operating and latching elements being normally held apart by a biasing means. When the correct sequence of manipulations is performed on the operating element, the latching element is caused to disengage from a striker plate to allow the door to be opened.

8 Claims, 17 Drawing Figures

DOOR CATCHES

The present invention relates to door catches, particularly to door catches for use on domestic appliances, for example front-loading washing machines and refrigerators.

There is a requirement among domestic appliance manufacturers for door catches which, while latching automatically and securely when a door is closed, require some manipulation to release them, the manipulation not being obvious from the external appearance of the latch. This is intended to prevent children from opening doors at inopportune moments, for example when a washing machine is full of water.

Known forms of "child-proof" closure mechanisms are operated by a "push and twist" action, where a circular control knob is urged axially and then rotated about its axis to operate a closure mechanism.

The closure of the present invention is operated on a different principle, there being no connection between the operating part of the catch and the latching part until the catch is operated.

According to the present invention, a door catch assembly includes an elongate latching element, a housing, and an operating element, the latching element being mounted in the housing for rotation about a first axis, the operating element being mounted both for linear motion between an operative position adjacent to and an inoperative position away from the first axis and for rotation about axes parallel to the first axis, the operating and latching elements being urged apart by resilient biasing means, and co-operating engaging means being provided on the operating and latching elements, the engaging means being so arranged that when the operating element is in the operative position, rotation of the operating element causes the latching element to rotate.

According to a preferred embodiment of the present invention, a door catch assembly comprises a generally cup-shaped housing having two opposed slots in its sides and an aperture in its base, an elongated latching element formed at one end with a hook and at its other end with a spigot, the spigot extending from a seating portion, which in use co-operates with the aperture in the base of the housing, the hook of the latching element extending through the aperture, the assembly further including an operating element formed with lugs which co-operate with the slots in the housing part to retain the operating element to the housing part allowing relative rotation and translation between the two parts, the operating element being further formed with a recess of a size and shape similar to the spigot on the latching element, and a resilient biasing means acting on the latching element and on the operating element to urge them apart, the housing, operating element, latching element and resilient biasing means being so disposed and configured that the operating element may move toward the latching element, against the action of the resilient biasing means, to engage the spigot on the latching element with the recess in the operating element, and the operating element and latching element may thereafter be rotated as a unit about an axis transverse to the latching element.

It should be recognised that the cup-shaped part including the slots may be formed on the undersurface of the finger plate and the housing would then comprise an apertured base, from which base extend two projections carrying opposed lugs. The cup-shaped part may be replaced in either of these two constructions by a more skeletal type of configuration, thus saving materials.

It is also possible to form the underside of the finger plate with a spigot, which may engage an aperture in the latching element to prevent the two parts from rotating relative to each other during operation of the catch.

Preferably, the engagement between the operating element, i.e. the finger plate, and the latching element is such that rotation in one direction only may be imparted to the latching element by the finger plate. This is most advantageously achieved by forming the finger plate with a slot on its underside, and forming the latching element with a spigot to engage one end surface of the slot. The operation and advantages of this type of engagement will be described below, in relation to the preferred embodiment of the invention.

An embodiment of the invention will now be described in detail, with reference to the accompanying drawings, in which.

Figure 3:
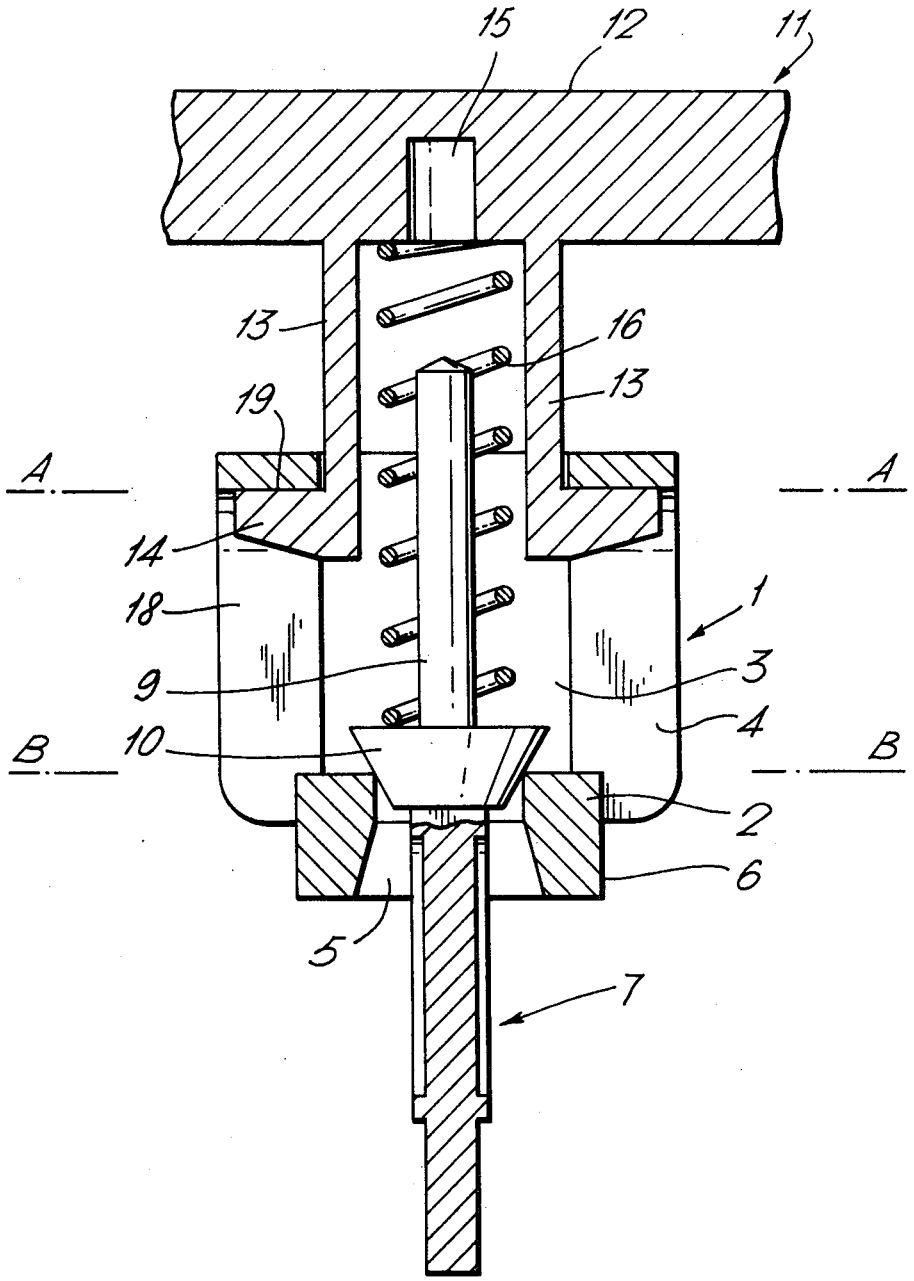
FIG. 3 is a section taken in the plane III-III of FIG. 1, showing the catch assembled; and, FIGS. 4 to 10 show various stages in the operation of the catch.

The views for FIGS. 4 to 10 are taken in the direction of the arrow B in FIG. 3. FIGS. 4*a* to 10*a* show central cross-sections corresponding to FIGS. 4 to 10 respectively, the sections being taken in the plane C—C of FIG. 3, but omitting to show the spring.

The catch assembly illustrated comprises a housing 1 of generally cup-shaped configuration, including a base 2 and sidewalls 3. The sidewalls are formed with two opposed slots 4, and the base is penetrated by an aperture 5. On the exterior surface of the base is a fastener 6, of a type known in the art; an example of this type of fastener may be found described in British Pat. No. 1,219,007.

Figure 4:
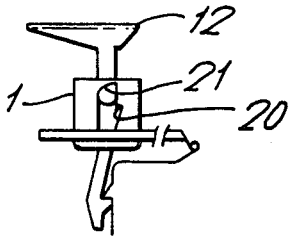
Figure 5:
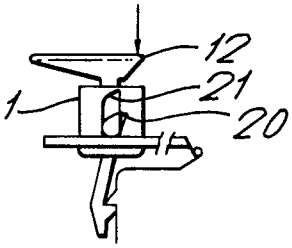
Figure 6:
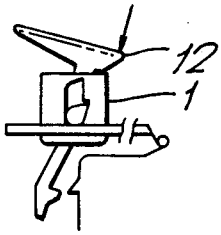

The elongated latching element 7 has at one end a hook 8 and at the other end a spigot 9, which has a conical tip. Adjacent to the spigot is a seating portion 10, which in use seats in the aperture 5 in the base 2 of the housing part 1. The seating portion 10 may be exactly conical, or may be oval or have one or more flat surfaces to co-operate with a complementary aperture to ensure that the hook member only seats in one rotational alignment. It is possible to replace the conical portion with a spherical or pyramidal portion if the aperture 5 is altered accordingly. A preferred configuration is a part-cylindrical portion, with its axis aligned so that rotation about the axis causes the hook 8 to move in and out of engagement with a striker plate, as seen in FIGS. 4 to 6. The base 2 of the housing 1 is formed with surfaces to co-operate with the seating portion 10.

Figure 1:
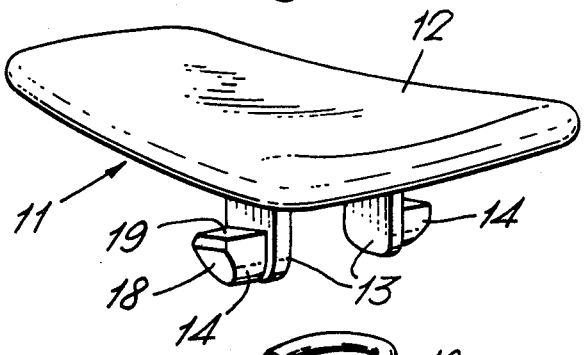
FIG. 1 is an exploded view of the various parts of a door catch assembly.
Figure 2:
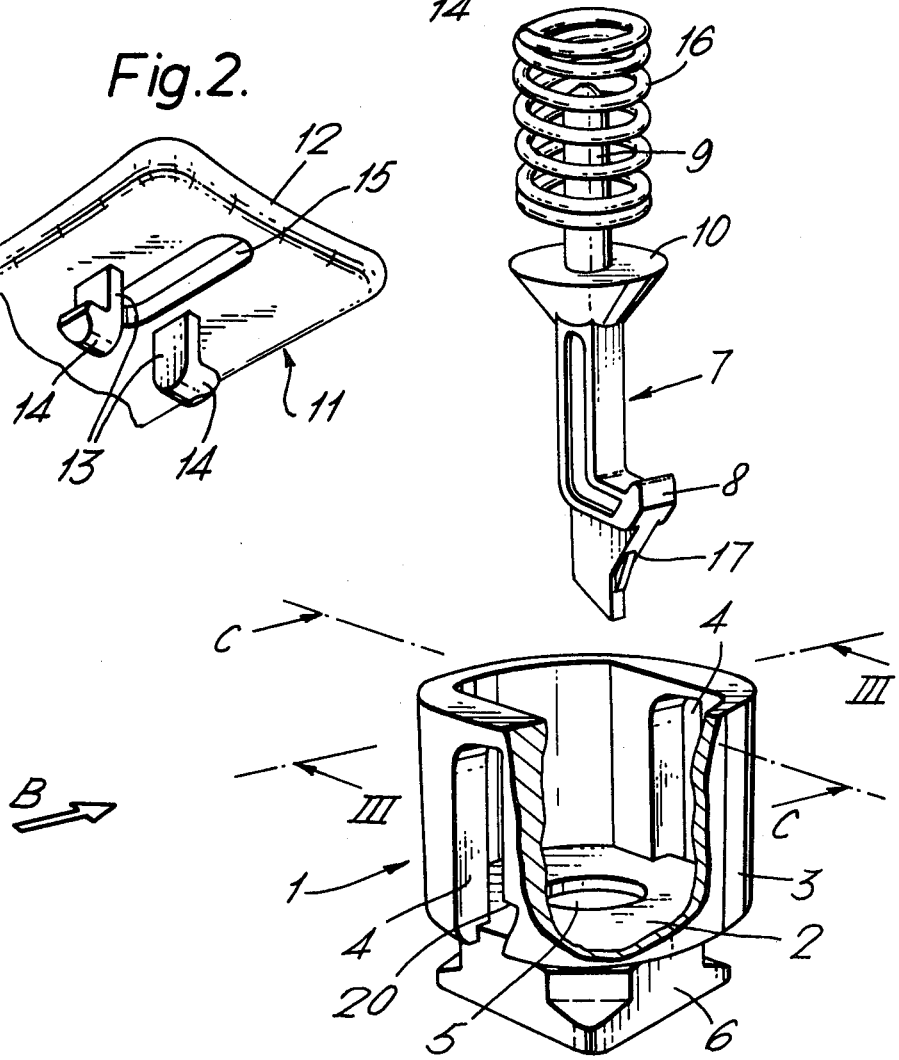
FIG. 2 shows an underneath view of one of the parts shown in FIG. 1.

The operating element 11 of this embodiment of the invention comprises a planar finger plate 12 formed on its underside with projections 13 on which are formed lugs 14. The lugs 14 have ramp surfaces 19 formed thereon, to facilitate assembly of the latch mechanism. Cusps 21, seen in FIGS. 4 to 10, are formed on the lugs to effect the opening of a door fitted with the latch assembly. The action of the cusps 21 will be further described below. A recess, best seen in FIG. 2, is also formed on the underside of the finger plate 12.

When the catch is assembled, the latching element 7 extends through the aperture 5 in the housing part, the hook 8 being situated below the fastener 6. A spring 16 is then placed over the spigot 9 of the latch member, to bear upon the upper face of the seating portion 10. The operating element is then positioned above the housing part 1 with the lugs 14 aligned with slots 4 in the sidewalls 3 of the housing part, and the open end of the slot 15 aligned with the bight of the hook 8. The operating member is then pressed downwards, and the ramp surfaces 18 of the ends of the lugs cause the projections 13 to deflect and snap the lugs 14 into position in the slots 4.

Figure 4A:
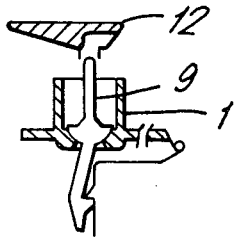

In this condition, also seen in FIGS. 4 and 4*a*, the spring 16 urges the operating element away from the latching element, ensuring accurate seating of the latching element in the aperture 5. The flat surfaces 19 of the lugs 14 abut the ends of the slots 4 to ensure that the finger plate is centred in a plane substantially parallel to the base 2 of the housing part 1.

Figure 5A:
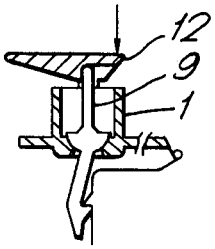

To operate the catch, the finger plate is first pushed. This causes the operating member to move linearly towards the latch member, as seen in FIGS. 5 and 5*a*, moving the lugs 14 downwards in the slots 4, and compressing the spring. As the operating element approaches the latching element, the spigot 9 of the latching element enters the slot 15 in the finger plate. The conical tip of the spigot 9 allows small misalignments between the spigot 9 and the slot 15 to be accommodated.

Figure 6A:
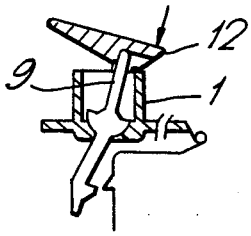
Figure 7:
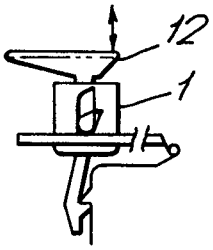
Figure 7A:
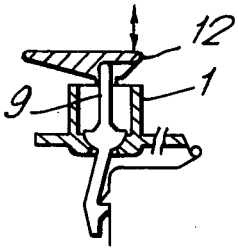
Figure 8:
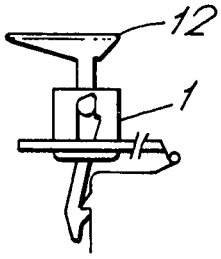
Figure 8A:
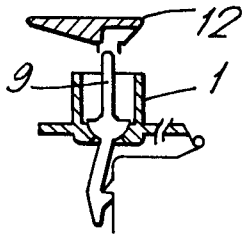
Figure 9:
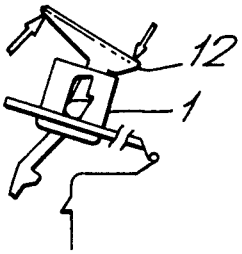
Figure 9A:
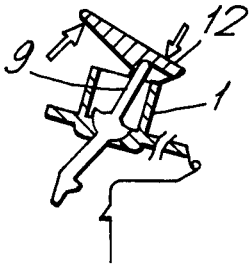
Figure 10:
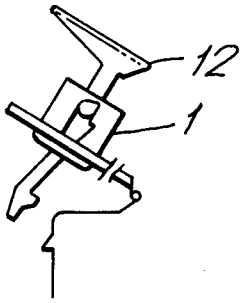
Figure 10A:
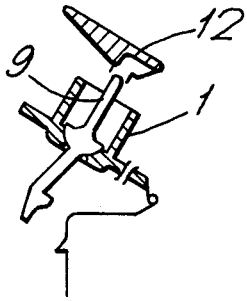

The catch is finally released by rocking the finger plate about an axis passing through the two lugs 14, clockwise as seen in FIGS. 6 and 6*a*, the rotation being transmitted to the latching element via the engagement of the spigot with the end surface 22 of the slot 15. The lugs 14 are formed with cusps 21, the action of which is best seen in FIGS. 4 to 6, which are aligned with recesses 20, formed at the ends of the slots 4, after the finger plate has been rotated to operate the catch. The engagement of the cusps 21 of the lugs 14 with the recesses 20, seen in FIG. 6, allows the door to be pulled open by pulling the finger plate 12, without the spigot of the latching element becoming disengaged from the slot in the finger plate. The recesses 20 and cusps 21 are unnecessary if the door is biased toward its open position by means of a spring or the like which can overcome the moment exerted on the door by the compressed spring of the catch assembly.

Instead of linear slots in the housing, the slots may be of helical configuration, formed in an annular wall extending from the base of the housing. This configuration would make it necessary to push and twist the operating element simultaneously to bring the operating and latching elements into engagement, whereafter the operating element could be rocked to disengage the latch, as described above.

When the finger plate is released, the operating element and latching element are urged apart by the spring, which ensures that the latching element is seated in the aperture and centralised, ready for the next latching operation when the door is closed. The guide 17 ensures that the hook is deflected when engaging a striker plate, in a manner allowing the latching element to spring back, under the action of the spring and seating portion, and engage the striker plate. The slotted configuration of the recess 15 prevents the latching element from moving the finger plate during closing of the door, and also prevents the latching element from being urged to rotate in the wrong direction by mistake. The finger plate is held in a central position as described above by the spring 16, after the door is closed.

FIGS. 7, 7*a*, 8 and 8*a*, show what happens when the finger plate is pushed and released. The operating element moves to engage the latching element member, but without the rocking action of the finger plate in the correct sense, i.e. clockwise as seen in FIG. 4, the latching element cannot be rotated and the catch disengaged. Release of the finger plate allows the spring to return it to its original condition, with the operating and latching elements disengaged.

Preferably, the housing, operating element and latching element are all integral plastics mouldings, but they may be formed of alternative materials, for example, pressed steel or cast alloys.

The resilient part is, in the preferred embodiment described, a helical spring, but may be any alternative equivalent component, for example a resilient rubber tube or a fluid-filled sac. The only limit on the choice of component is that the resilient part must urge the operating and latch members away from each other, while not interfering with the engagement of the two members during operation of the latch. The exact shape of the hook of the latch member will depend on the type of electrical or mechanical interlock with which it cooperates.

We claim:

1. A four piece door catch assembly for mounting on the door of a cabinet or the like to cooperate with a ledge or the like on a complementary cabinet including an elongated latching element, a housing having integral means for mounting said housing on a workpiece, and an operating element, the latching element being mounted in the housing on a first axis, said housing presenting a centrally located aperture for cooperation with an operating element, the operating element being operated within said housing both for motion between an operative position when located on said first axis and to an inoperative position when tilted away from the first axis, said operating element having a hook-shaped terminal end located beyond and cooperatively engaging an undersurface radially outwardly of the margin of the aperture presented by said latching element, the operating and latching elements being urged apart by a spring biasing means oriented on said first axis and cooperating engaging means being provided on the operating and latching elements consisting of a spigot and socket arrangement respectively, the engaging means being so arranged that when the operating element is in the operative position rotation of the operating element causes the latching element to rotate.

2. A door catch assembly according to claim 1, in which the housing includes a base portion having an aperture through which the latching element projects in use, the base and the latching element being formed with complementary seating surfaces to allow rotation of the latching element relative to the base portion.

3. A door catch assembly according to claim 2, in which the seating surfaces are conical, the axis of the cones being coincident with the first axis.

4. A door catch assembly according to claim 1, in which the operating element is mounted to the base by means including two opposed walls formed with slots, the walls extending either from a base portion of the housing, the mounting means further including two opposed co-axial lugs mounted either on the operating element or the base portion of the housing, the lugs co-operating with the slots to allow relative rotation of the operating element and housing about the axis of the lugs.

5. A door catch assembly according to claim 4, in which the walls are formed on a base portion of the housing, and in which the slots have widened portions at their ends adjacent to the base portion, forming a step facing the base, and the lugs of the operating element are formed with cusps which are capable of abutting the steps when the operating element is rotated relative to the housing.

6. A housing for a door catch assembly according to claim 1, including an apertured base and two opposed upstanding walls extending therefrom, each wall being formed with a slot extending away from the base, and the base being formed with a part cylindrical seating portion, the axis of the cylinder of which the seating portion is a part passing through the two slots in the walls.

7. A latching element for a door catch assembly according to claim 1, comprising a central seating portion of generally part cylindrical configuration, a hook extending from the curved surface of the seating portion, and an elongated spigot extending from the seating portion in the opposite direction to the hook, the seating portion being also formed with a bearing surface surrounding the base of the spigot.

8. An operating element for a door catch assembly according to claim 1, comprising a finger plate having on one of its faces two canti-lever arms, the free ends of the arms supporting two opposed co-axial lugs, the finger plate being also formed with a slot extending in a plane substantially perpendicular to the axis of the lugs.

* * * * *